United States Patent [19]

Weber

[11] 4,276,930

[45] Jul. 7, 1981

[54] TUBE NEST FOR A HEAT EXCHANGER

[75] Inventor: Max Weber, Weisendangen, Switzerland

[73] Assignee: Sulzer Brothers Limited, Winterthur, Switzerland

[21] Appl. No.: 57,018

[22] Filed: Jul. 12, 1979

[30] Foreign Application Priority Data

Jul. 12, 1978 [CH] Switzerland ..... 7573/78

[51] Int. Cl.[3] ..... F28F 9/00; F22B 37/20

[52] U.S. Cl. ..... 165/172; 165/162

[58] Field of Search ..... 165/172, 171, 162, 178; 122/510

[56] References Cited

U.S. PATENT DOCUMENTS

| | | | |
|---|---|---|---|
| 2,477,950 | 8/1949 | Bailey | 122/510 |
| 3,324,838 | 6/1967 | Eilers | 122/510 |
| 3,639,963 | 2/1972 | Maher | 165/162 |
| 3,896,771 | 7/1975 | Chayes et al. | 165/162 |
| 4,135,575 | 1/1979 | Gersch | 165/171 |

FOREIGN PATENT DOCUMENTS

| | | | |
|---|---|---|---|
| 935409 | 6/1948 | France | 165/172 |
| 1229638 | 9/1960 | France | 122/6 A |
| 1110439 | 4/1968 | United Kingdom | 122/6 A |
| 1301098 | 12/1972 | United Kingdom | 165/172 |

*Primary Examiner*—Sheldon J. Richter

*Attorney, Agent, or Firm*—Kenyon & Kenyon

[57] ABSTRACT

The tube nest has several groups of approximately horizontal tubes arranged vertically one above the other. The tubes of each group are welded together through ribs which are arranged eccentric in relation to the tubes in such a way that the outer faces of each rib are approximately in alignment with the outermost generatrix of the tubes. The bending stress of the tubes is considerably reduced.

12 Claims, 7 Drawing Figures

TUBE NEST FOR A HEAT EXCHANGER

This invention relates to a tube nest for a heat exchanger. More particularly, this invention relates to a tube nest for a heat exchanger wherein heat is transferred by contact.

Heretofore, various types of tube nests have been known for use in heat exchangers. For example, as described in Swiss Pat. No. 550,984, one known tube nest of helix form has several groups of tubes with the tubes in each group arranged on an approximately horizontal axis, one vertically above the other, and connected together by several rows of ribs distributed over the length of the tubes. The ribs are arranged vertically one above the other per row and are welded to pairs of adjacent tubes. In this tube nest, the center lines of the ribs or fins pass through the tube axis as is customary, also, in hermetically welded tube panels which form the walls of combustion chambers for steam generators. The joining together of tubes by ribs welded to the tubes and the suspending of the tube nest has the advantage that the individual tubes are stiffened to form a sturdy structure in which no considerable vibration can occur. Such vibrations are feared in heat exchangers operating in an inert gas atmosphere, e.g., helium, because certain fretting phenomena may occur in which considerable material is eroded at the tubes and or at the tube suspensions.

However, the known arrangement of ribs has the disadvantage that the tube walls are subjected to bending stresses due to the central connection of the ribs. In the case of tube nests operating in a high temperature range, these additional bending stresses may require the use of tubes of thicker walls. Such a solution, however, has the disadvantage not only that the heat exchanger becomes heavier but also that the highest temperatures on the tube wall are higher.

Accordingly, it is an object of the invention to reduce the amount of vibration in a tube nest.

It is another object of the invention to reduce the amount of bending stresses in a tube nest for a heat exchanger.

It is another object of the invention to provide a tube nest of interconnected tube coils of relatively rigid construction which can be suspended without inducing high bending stress in the tube coils.

Briefly, the invention provides a tube nest for a heat exchanger which has a plurality of tube groups each of which has tubes disposed in approximately horizontal planes and vertical disposition relative to each other and a plurality of ribs interconnecting the vertically disposed tubes of each tube group. Each rib is integrally secured between two vertically disposed tubes eccentrically of each tube so that each rib has an outer face aligned with a corresponding outermost generatrix of an integrally connected tube.

The eccentric arrangement of the ribs reduces the bending stresses on the tubes as compared with the known tube nests in a simple manner. Therefore, because thinner-walled tubes can be used, the weight of the tube nest is lighter. This permits the use of the tube nest in heat exchangers which are operated at relatively high temperatures of the medium, e.g., in connection with high-temperature reactors.

In addition, the ribs of adjacent tube groups can be provided with flanges and webs which interfit with one another to prevent lateral displacements.

These and other objects and advantages of the invention will become more apparent from the following detailed description taken in conjunction with the accompanying drawings wherein.

Figure 1:
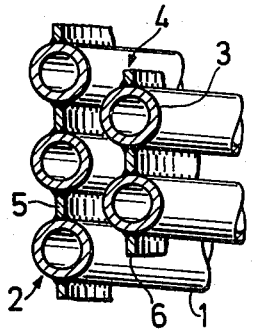
FIG. 1 PRIOR ART
FIG. 1 illustrates a fragmentary detail of a helix heat exchanger according to the prior art.

Referring to FIG. 1, a known tube nest has, for example, a first tube 1 bent along a helical line to form an outer tube cylinder 2 and a second tube 3, also bent along a helical line, to form an inner tube cylinder 4. The tube cylinders 2, 4 are concentric and form component parts of a helix heat exchanger consisting of further concentrically arranged tube cylinders. The individual turns of the tubes 1, 3 are connected by ribs 5, 6 which are welded to the tubes and extend centrally to the circular cross-sections of the tubes 1, 3.

Due to these ribs 5, 6, the tube cylinders 2, 4 become stiff structures which show no tendency whatever to vibrate. Instead of the ribs 5, 6 extending over the circumference in multiple arrangement, it is possible also according to the state of the art to arrange several short ribs, whose dimension in the direction of the circumference is comparable, for example, with the tube diameter.

In this known arrangement, when the tube nest is suspended in place at least the uppermost tube turns are so loaded by the weight of the tubes suspended from them that considerable bending stresses may occur in the tube wall. Such bending stresses can be reduced by thickening the tube wall, but this leads to a heavy construction.

Figure 2:
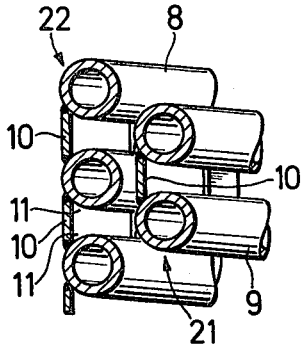
FIG. 2 illustrates a fragmentary detail of a helix heat exchanger according to the invention.

Referring to FIG. 2, in accordance with the invention, the tube nest for a heat exchanger has a plurality of tube groups, each of which has tubes disposed in approximately horizontal planes and vertical disposition relative to each other. As shown, a first tube 8 of the tube nest extends helically to form an outer tube group or cylinder 22 and a second concentrically adjacent tube 9 also extends helically to form an inner tube group or cylinder 21. The individual turns of the tubes 8, 9 in the cylinders 21, 22 are connected together by ribs 10 which are of about the same thickness as the walls of tubes 8, 9. Each rib 10 is integrally secured, as by welds, between two vertically disposed tubes (i.e., turns) of each tube group 21, 22 eccentrically of each tube. In contrast to the ribs 5, 6 of FIG. 1, each rib 10 has an outer face aligned with a corresponding outermost generatrix of an integrally connected tube so that, externally, they are flush with the tubes.

Measured in the circumferential direction of the tube cylinders 21, 22, the ribs 10 are relatively short, i.e., in the order of the outside diameter of the tube, so that the gusset spaces 11 between the outer faces of the tubes 8, 9 and the side of the ribs 10 toward them become relatively short. Heat transfer is impaired in these gusset spaces because the flow velocity is reduced there. However, due to the limited dimension of the interspaces 11, this impairment of the heat transfer remains insignificant. Besides, a certain compensation occurs due to the fact that the ribs 10 participate in the heat transfer and yield additional heat to the adjacent tubes precisely in the region of the gusset spaces 11.

Figure 4:
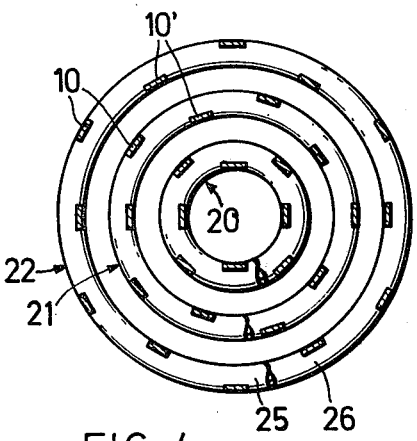
FIG. 4 illustrates a horizontal section of a helix heat exchanger with tube cylinders according to FIG. 3.

Referring to FIG. 4, wherein like reference characters indicate like parts as above, the helix heat exchanger has three innermost tube cylinders 20, 21, 22. While a single tube is provided in each of the two inner tube cylinders 20 and 21, two tubes are provided in the outermost tube cylinder 22. These two tubes 25, 26 are coiled, one in the other, and have a pitch between that of the two tubes of the inner cylinders 20, 21. The resulting increase in the number of tubes with the tube cylinder diameter allows tubes of equal length, coiled on different diameters, to have approximately the same length, measured in the direction of the axis of the tube cylinder, as is frequently demanded in the practice.

Figure 3:
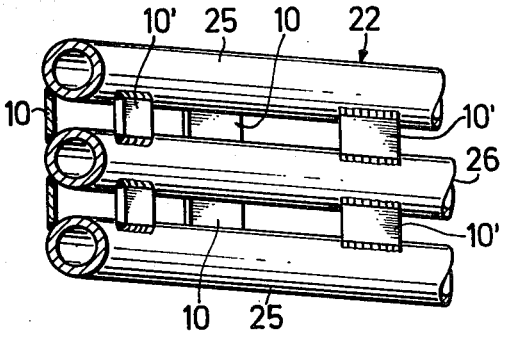
FIG. 3 illustrates a detail of a modified tube cylinder for a helix heat exchanger in accordance with the invention.

Referring to FIG. 3, in contrast to FIG. 2, the ribs 10, 10' can be alternately disposed on opposite sides of a respective tube 25, 26, i.e., being alternately welded on different sides of the tube. As shown, each rib 10,10' has an outer face aligned with a corresponding generatrix of the interconnected tubes 25, 26, i.e. The ribs 10 are aligned with the outermost generatrix and the ribs 10' aligned with the innermost generatrix. This form of construction has the advantage that the ribs are only negligibly subjected to bending stresses. A more favorable construction in this respect would be to arrange a rib on each of the two tube sides at the same tube cross-section, so that the two ribs would be opposite each other on the same tube. Such a solution, however, would have the disadvantage that the interspace between the two ribs would not be flushed well by the medium sweeping the tubes.

Figure 5:
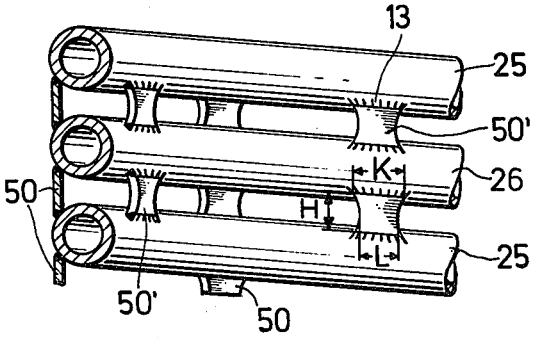
FIG. 5 illustrates a detail of a further modified tube cylinder in accordance with the invention.

Referring to FIG. 5, each rib 50, 50', can have a narrowed portion at mid-length relative to the ends secured to the tubes. For example, as shown, each rib 50, 50' is narrow-waisted so that, measured at mid-height of the ribs, their length L is considerably smaller than the length K of the rib edges 13 welded to the adjacent tubes 25, 26. This shape of the ribs 50, 50' brings the advantage that the stresses in the tube walls are reduced in the region of the rib corners. Another advantage is that the highest rib temperatures, which occur at mid-point of the ribs at the edges, are lower than in the case of rectangular ribs. The constriction K−L is expediently 0.2 to 2 times the height H of the rib.

Figure 6:
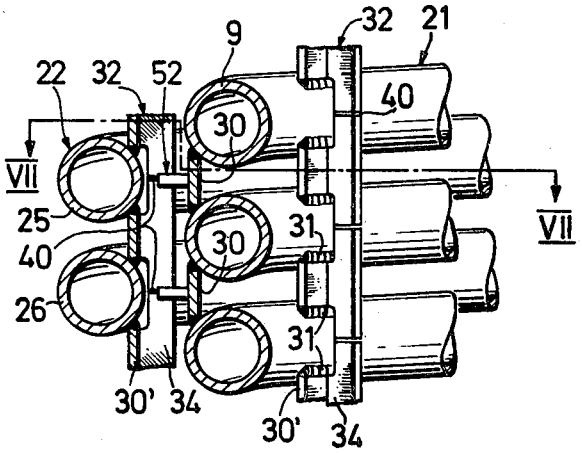
FIG. 6 illustrates a fragmentary detail through a further modified helix heat exchanger according to the invention.
Figure 7:
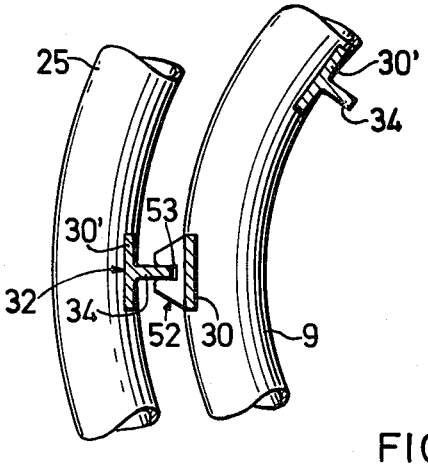
FIG. 7 illustrates a view taken on line VII—VII of FIG. 6.

Referring to FIGS. 6 and 7, a T-shaped rod 32 can be welded to a tube group 21, 22 to define a vertical row of ribs 30'. As shown, the rod 32 is milled out in the region of each tube 9, 25, 26 and is welded to the tubes 9, 25, 26 on the inner side of the tube groups 21, 22 by beads 31. As shown, the vertically disposed web 34 of the rod 32 has sections spaced from the tubes 9, 25, 26 while the remaining portions of the flange of the rod 32 form the ribs 30'.

After welding of the T-section rods 32 to the tubes 9, 25, 26 along the milled flange edges, the webs 34 remaining in the region of the recesses can be sub-divided by thin separating cuts 40, so that the web sections, which in operation assume a somewhat higher temperature than the tube walls, will not cause any additional thermal stresses in the tube. As shown, each cut 40 defines a small gap in a horizontal plane of an adjacent tube.

In addition, each rib 30 of a vertical row facing a rod 32 has a horizontally disposed web 52 welded thereon to extend outwardly to define a T-section member. As shown, these ribs 30 are welded to the tubes 9 on the inner tube group 21 on the outer side.

The web 52 of each T-section member extends in the direction of the tube axis and is provided with a vertically disposed cross slot 53, which receives the web 34 of an adjacent T-shaped rod 32, preferably with play in the radial direction. By this arrangement, the individual tube cylinders 21, 22 are braced against each other and against outer and inner cylindrical limiting walls of the heat exchanger (not shown) to prevent lateral displacements. The radial play in the cross slots 53 prevents heat expansion differences of adjacent tube cylinders or limiting walls from imposing additional stresses in the tubes.

The invention is not limited to helix heat exchangers. It is possible also, for example, to arrange the ribs in tube nests composed of tube groups whose tubes are bent in a serpentine form in a vertical plane.

What is claimed is:

1. A tube group for a heat exchanger comprising a plurality of tubes disposed in approximately horizontal planes and vertical disposition relative to each other; and a plurality of ribs interconnecting said vertically disposed tubes of each tube group and being alternately disposed on opposite sides of a respective tube, each said rib being integrally secured between two vertically disposed tubes eccentrically of each said tube, each rib having an outer face aligned with a corresponding generatrix of said two integrally connected tubes.

2. A tube group as set forth in claim 1 wherein said ribs are disposed in vertical rows.

3. A tube nest for a heat exchanger comprising a plurality of tube groups, each tube group having tubes disposed in approximately horizontal planes and vertical disposition relative to each other; and a plurality of vertical ribs interconnecting said vertically disposed tubes of each tube group and being alternately disposed on opposite sides of a respective tube, each said rib being integrally secured between two vertically disposed tubes eccentrically of each said tube, each rib having an outer face aligned with a corresponding generatrix of said two integrally connected tubes.

4. A tube nest as set forth in claim 3 wherein said ribs are welded to said tubes.

5. A tube nest as set forth in claim 3 wherein said tubes are bent along a helical line and said ribs are spaced apart circumferentially along said tubes.

6. A tube nest as set forth in claim 3 wherein said tube groups are disposed about a vertical axis and said ribs are disposed in vertical rows.

7. A tube nest as set forth in claim 3 wherein each rib has a narrowed portion at mid-length relative to the respective ends thereof secured to said tubes.

8. A tube nest as set forth in claim 3 wherein said tube groups are disposed about a vertical axis and said ribs are disposed in vertical rows, and wherein a T-shaped rod forms at least one of said rows of ribs, said rod having a vertically disposed web interconnecting said ribs of said one row with sections spaced from said tubes between said ribs of said one row.

9. A tube nest as set forth in claim 8 wherein said web is sub-divided into a plurality of sections with each pair of adjacent sections defining a small gap in a horizontal plane of a respective adjacent tube.

10. A tube nest as set forth in claim 3 wherein said tube groups are disposed about a vertical axis and said ribs are disposed in vertical rows, and wherein each rib of at least one row has a horizontally disposed web extending therefrom to define a T-section member.

11. A tube nest as set forth in claim 10 wherein each web has a vertically disposed slot therein.

12. A tube nest as set forth in claim 3 wherein said tube groups include at least two concentric tube groups disposed on a vertical axis in adjacent relation with said ribs disposed in vertical rows, at least one of said rows of ribs of one of said two tube groups having a horizontally disposed web extending from each rib thereof with a vertically disposed slot therein and at least one of said rows of ribs of the other of said two tube groups having a vertically disposed web extending therefrom into a slot of at least one adjacent horizontally disposed web.

* * * * *